US008074386B2

(12) United States Patent
Marantz

(10) Patent No.: US 8,074,386 B2
(45) Date of Patent: Dec. 13, 2011

(54) INTEGRATED MIRROR AND GRAPHICS DISPLAY SYSTEM

(76) Inventor: Jacob J. Marantz, Cooper City, FL (US)

( * ) Notice: Subject to any disclaimer, the term of this patent is extended or adjusted under 35 U.S.C. 154(b) by 0 days.

(21) Appl. No.: 12/590,746

(22) Filed: Nov. 12, 2009

(65) Prior Publication Data

US 2011/0107631 A1 May 12, 2011

(51) Int. Cl.
*A47G 1/06* (2006.01)

(52) U.S. Cl. ..... 40/219; 40/427

(58) Field of Classification Search ..... 40/219
See application file for complete search history.

(56) References Cited

U.S. PATENT DOCUMENTS

| | | | | |
|---|---|---|---|---|
| 1,202,593 | A * | 10/1916 | Scott | 40/219 |
| 1,805,798 | A * | 5/1931 | Bedrossyan | 40/541 |
| 2,132,475 | A | 10/1938 | Holm | |
| 2,221,887 | A * | 11/1940 | White | 40/219 |
| 2,221,889 | A * | 11/1940 | White | 40/219 |
| 4,747,223 | A | 5/1988 | Borda | |
| 5,416,313 | A * | 5/1995 | Larson et al. | 250/214 AL |
| 5,657,563 | A | 8/1997 | Lane | |
| 5,743,038 | A * | 4/1998 | Soto | 40/743 |
| 6,780,655 | B2 * | 8/2004 | Mattson | 438/3 |

FOREIGN PATENT DOCUMENTS

| | | |
|---|---|---|
| WO | WO 95/23401 | 2/1995 |

* cited by examiner

*Primary Examiner* — Casandra Davis
(74) *Attorney, Agent, or Firm* — Melvin K. Silverman; Yi Li

(57) ABSTRACT

An integrated mirror and graphics display system includes a sheet of substantially transparent material, the sheet having a front and a back, the back having a silvered or reflective region and at least one primary non-silvered region. Also included is a sheet of translucent material, having printed on or embedded in it a graphic of interest to a system user, the translucent sheet secured or painted upon the back of the transparent sheet against the non-silvered region. The system further includes an illumination element defining an area smaller, equal to or greater than that of the non-silvered region and secured in optical communication with the translucent sheet. A secondary non-silvered region may be used to provide owner-specific personalized information.

17 Claims, 4 Drawing Sheets

INTEGRATED MIRROR AND GRAPHICS DISPLAY SYSTEM

FIELD OF THE INVENTION

The present invention relates to display systems, and more particularly, to mirror display systems for different purposes, such as, for advertising.

BACKGROUND OF THE INVENTION

The widespread utilization of mirrors for advertising purposes is well known, with their visual illusions widening and heightening space and intensifying lighting. Mirrors provide a false sense of depth and provide a surface shine that is seen to complement contemporary interiors. Henceforth, commercial designers have exploited these visual characteristics and have employed mirrors and other reflective surfaces as a base upon which to paint slogans, logos, product container designs, and the like. Prior art known includes a patent to Borda, namely, U.S. Pat. No. 4,747,223, entitled Mirrored Communication System, which discloses a device for causing a plurality of images having different optical characteristics to appear through a continuous mirrored screen. Borda teaches a partially transparent mirrored screen extending continuously over a preselected area and containing a distribution of reflective material which varies in optical density to define regions of differing optical transmittance to light.

Multiple regions are selectively back-lighted to reveal two-dimensional or three-dimensional images embodied within media behind the screen. The densities of the regions are chosen so that the images are displayed clearly when the regions are back-lighted and disappear in the absence of backlighting, leaving the screen uniformly reflective of environmental light in an "off" condition. In a preferred embodiment of Borda, the reflective material includes a front layer of uniform optical density over the preselected area and a rear layer of non-uniform optical density. The front layer corresponds to the density required for the visibility of a first object or image-bearing sheet located behind one region of the mirror and the rear layer provides a different density for a sheet located behind another region.

Products of this type are offered commercially by Focus Technology Co., Ltd. under the name of MAGIC MIRROR.

The placement of a selectably illustrated image behind a one-way mirror is taught in U.S. Pat. No. 5,657,563 (1997) to Lane.

Previously known advertising mechanisms have also employed music or light effects to attract the consumers along with a graphical image of a product, which may be placed on the outside surface of the mirror. However, the product, as depicted in the graphic, is without any visual effects, so that the consumers can hardly be impressed by the product and consequently, the advertising effect is limited. An example thereof appears in WO 95/23401 to Werbe-Spiegel that teaches use of endless loop advertising behind a semi-reflecting mirror.

Other techniques for advertising have limited applications, mainly due to technology and cost factors, and, as a result, such advertising slogans, graphics, symbols, and the like, have been placed on the outside surface of the mirror. This surface placement tends to work against the illusion of depth that mirrors are otherwise able to create, although efforts have appeared in the art to use multiple mirrors to produce multiple images of the same product. See U.S. Pat. No. 2,132,475 (1938) to Holm.

Therefore, as may be seen, there exists a need in the art for a new age advertising mechanism that utilizes the visual dynamics offered by mirrors, along with the message, and which eliminates the recognized deficiencies of the prior art.

SUMMARY OF THE INVENTION

An integrated mirror and graphics display system comprises a sheet of substantially transparent material, said sheet having a front and a back, said back having a silvered or reflective region and at least a primary non-silvered region; a sheet of translucent material having printed thereupon, embedded therein, or in the form of a paint, a graphic of interest to a system user, said translucent sheet secured or adhered upon the back of said transparent sheet within or against said non-silvered region; and an illumination element defining an area smaller, equal to or greater than that of said non-silvered region and secured in optical communication with said translucent sheet and non-silvered region.

It is an object of the invention to provide a novel integrated mirror and graphic display system.

It is another object to provide a system capable of functioning as a mirror and a display of an affinity-related graphic.

It is a yet further object to provide a personalized affinity-related mirror and display system.

The above and yet other objects and advantages of the present invention will become apparent from the hereinafter set forth Brief Description of the Drawings, Detailed Description of the Invention and Claims appended herewith.

DETAILED DESCRIPTION OF THE INVENTION

Figure 1:
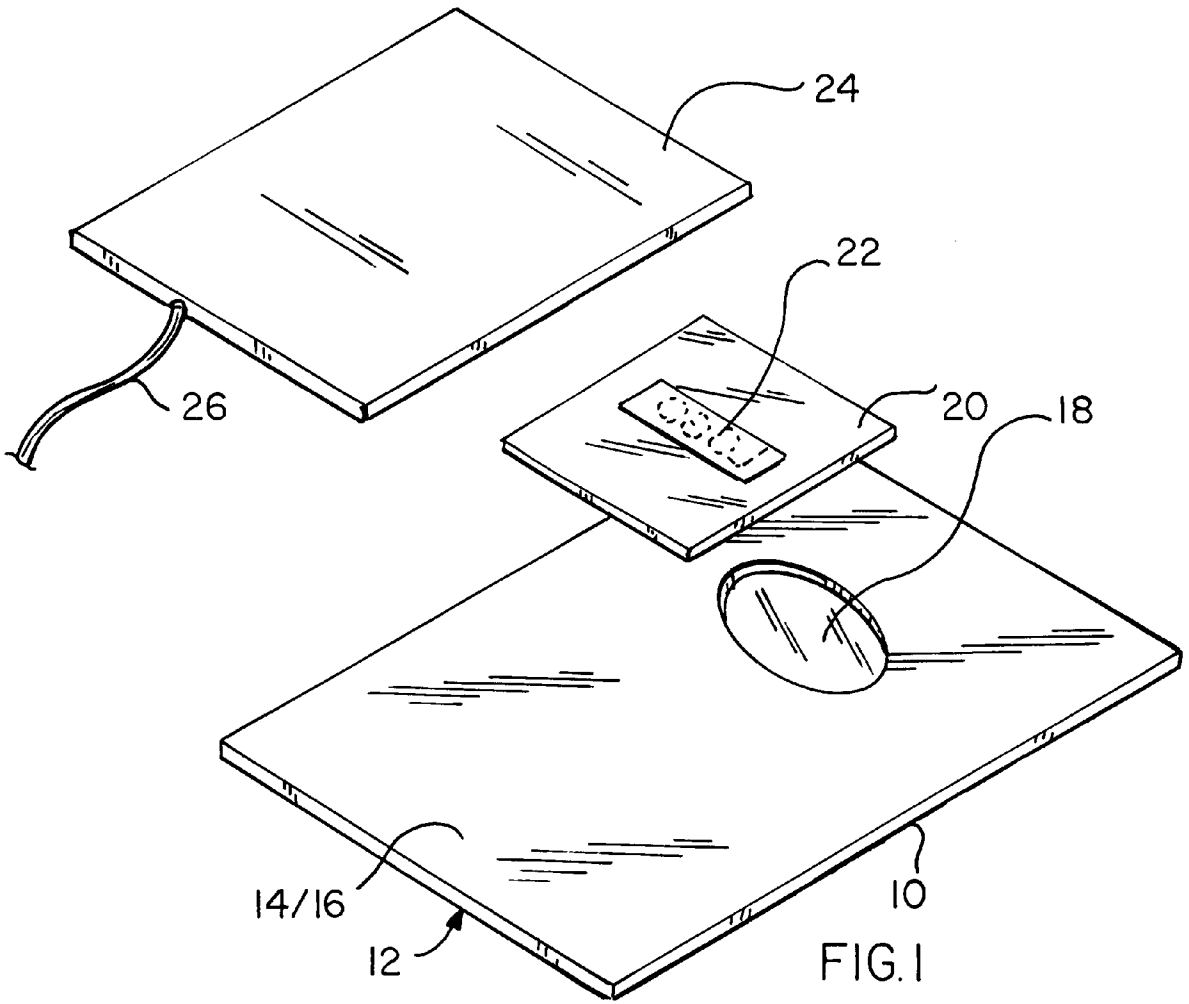
FIG. 1 is an exploded view of the present integrated mirror and graphics display system.

With reference to the exploded view of FIG. 1, the inventive integrated mirror and graphics display system may be seen to include a sheet of substantially transparent material 10 which, in a preferred embodiment, comprises a sheet of glass. Said sheet includes a front side 12 and a back or rear side 14 upon which is provided a silvered region 16 and at least a primary non-silvered region 18. The non-silvered region or regions must be completely clear and transparent. As used herein, the term silvered is to be understood to encompass any optically reflective agent disposed on the rear side 14 of sheet 10.

Further shown in the exploded view of FIG. 1 is a translucent sheet 20 having printed thereupon, or embedded therein, a graphic 22 of interest to a system user. Sheet 20 may be smaller, equal to, or larger, in area than the non-silvered region 18 and may take the form of either a sheet or printing directly upon non-silvered region 20.

Further shown in FIG. 1 is an illumination element 24 such as a planar LED which, in a preferred embodiment, will be entirely white light emitting. While other, traditional illumination element, such as a small fluorescent lamp may be used, a matrix (not shown) of light emitting LEDs within the geometry shown in FIG. 1 has been found to be an effective illumination for purposes of the present invention. Electrical cord 26 indicates that the LED may be provided with an external AC power source, however, batteries may also be provided, optionally internal to the matrix of LEDs, as the illumination element.

Figure 2:
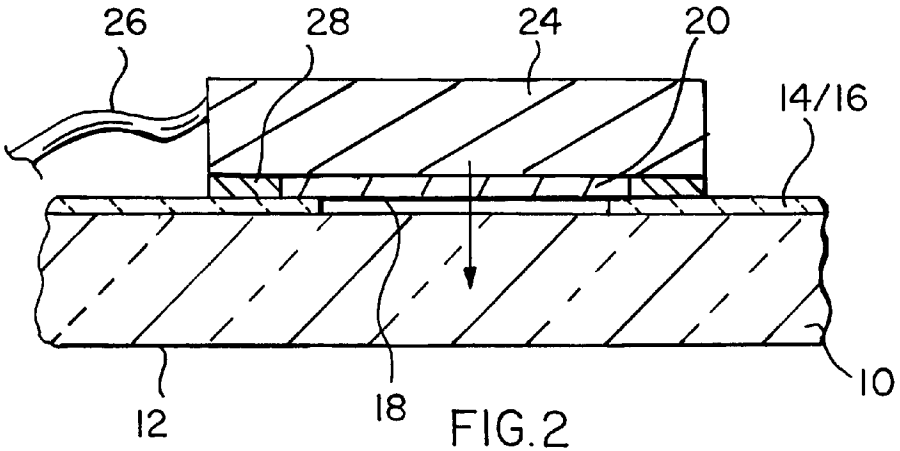
FIG. 2 is a vertical cross-sectional assembly view of the system of FIG. 1.

With reference to the assembly view of FIG. 2, translucent sheet 20 may be seen secured against non-silvered region 18 of the back of the mirror by illumination element of LED 24 thereupon. In one embodiment, such securement may be accomplished by adhesive 28 between the planar LED 24 and back 14 of glass 10.

Figure 3:
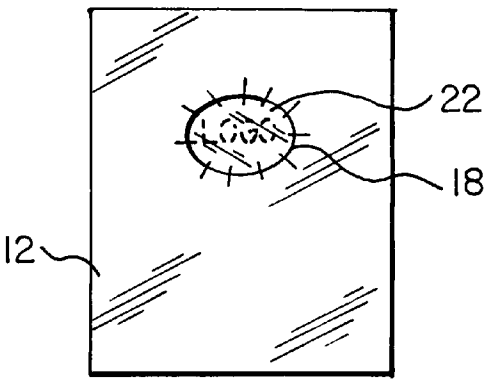
FIG. 3 is a front elevational schematic assembly view.

In FIG. 3 is shown a front perspective view of the inventive system as it appears after the assembly thereof. Shown therein is the illumination of the graphic or logo 22 provided upon the sheet 20 of translucent material. It is to be appreciated that such graphic, logo, or any combination thereof, may include a periphery considerably more complex than the oval shape shown schematically in FIG. 3. It is anticipated that the logos or graphic 22 will be theme-specific, i.e., may employ such terms as "All Star Sports/Water Polo" or "All Star Sports/Basketball" with images of a water polo ball or basketball respectively incorporated into each graphic.

Figure 5:
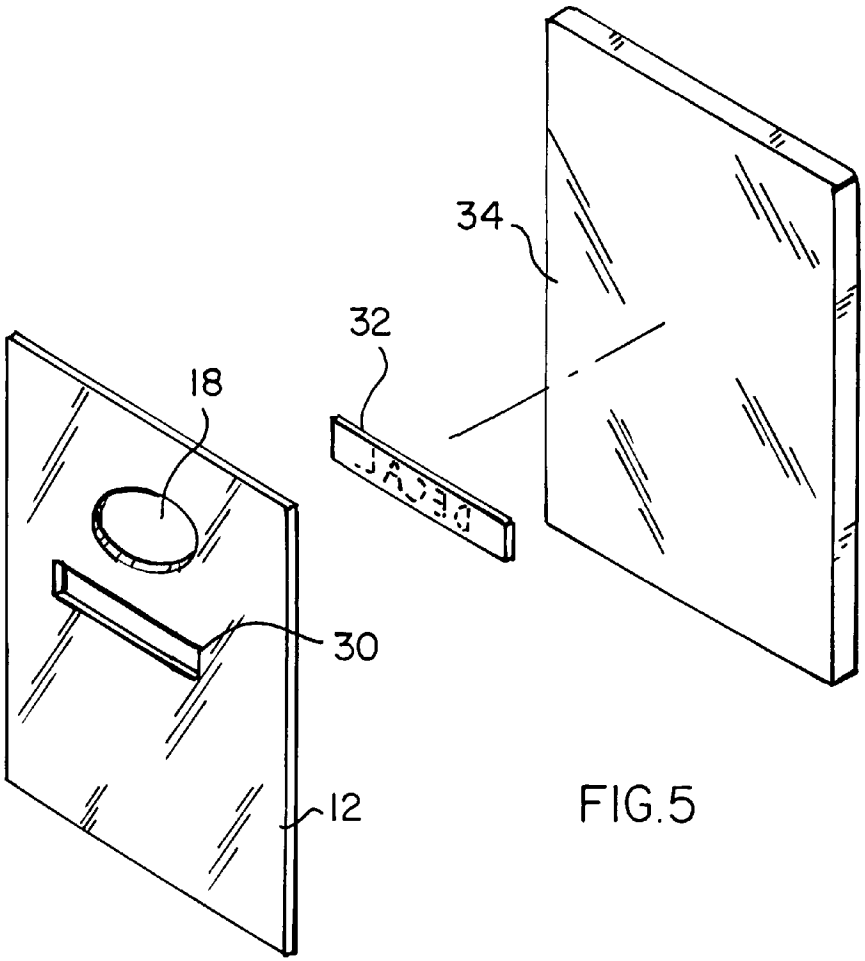
FIG. 5 is an exploded view of the embodiment of FIG. 4.
Figure 4:
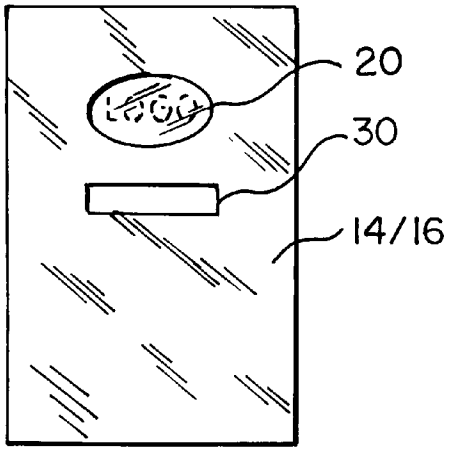
FIG. 4 is a view of the second embodiment of the invention.

The views of FIGS. 4 and 5 are shown in a second embodiment to the invention in which there is provided a second non-silvered region 30, below first non-silvered region 18, within with user-specific personalized information may be applied, this through any number of methods such as the use of a sheet of translucent material as taught in the embodiments of FIG. 1-3, by ion, other direct deposition upon second non-silvered area 30 or through the use of a decal 32 (see FIG. 5) which would facilitate ease of application of the personalized information within the non-silvered region 30. In this embodiment, an LED 34 of larger area, sufficient to illuminate regions 18 and 30, is provided.

Figure 6:
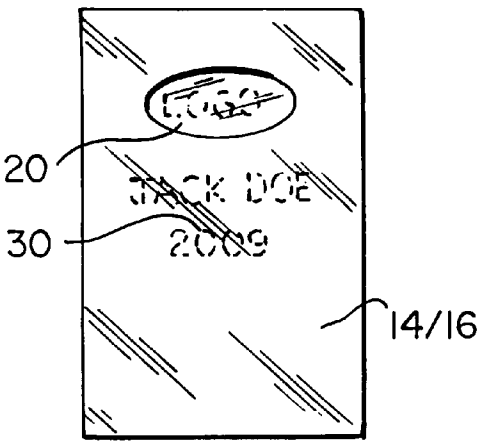
FIG. 6 is a view of a third embodiment of the invention.

Alternatively to the use of a non-silvered region 30 may be the direct printing or deposition of the personalized information upon the sheet of glass 10 and beneath the primary graphic 22, this as is shown in FIG. 6. Further, removal of silver, mercury or the like in region 30 may be accomplished by sand blasting or chemical etching.

Figure 7:
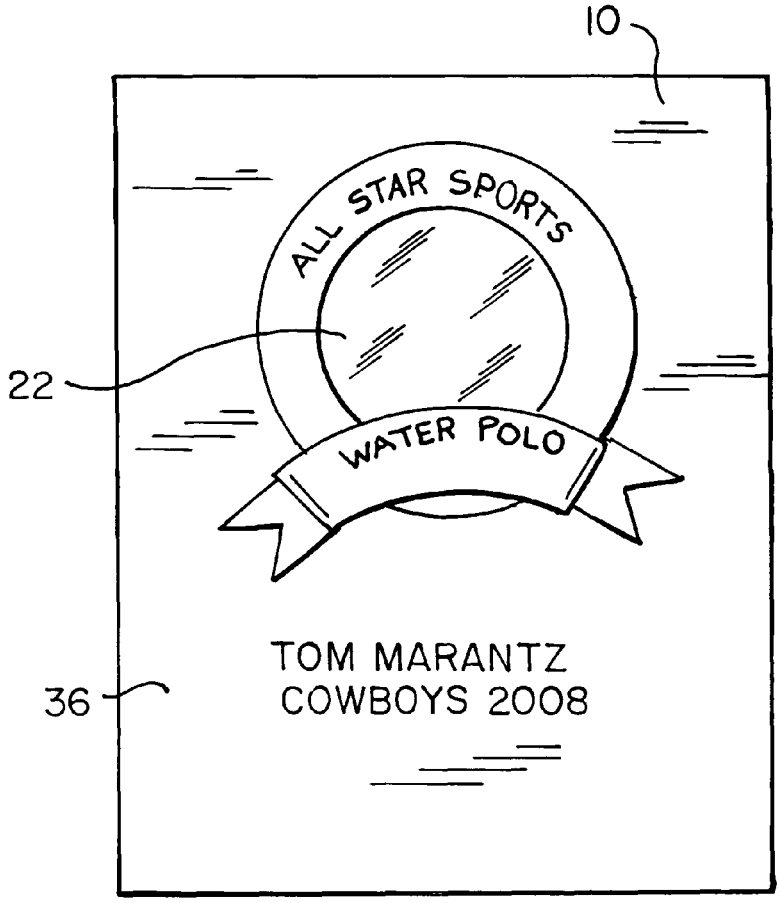
FIG. 7 is a perspective view of a commercial embodiment of the invention.

Shown in FIG. 7 is a commercial embodiment of the invention as set forth above.

Figure 8:
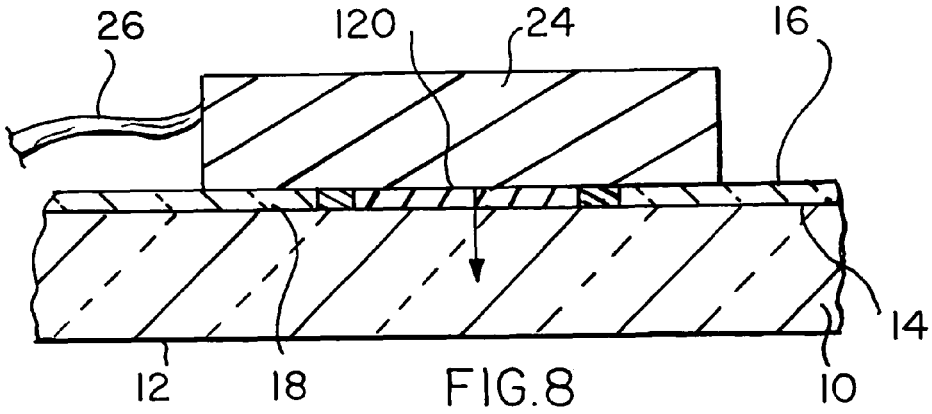
FIG. 8 is a view of a fourth embodiment of the invention.

FIG. 8 shows a further embodiment in which a translucent paint 120 may be applied to the non-silvered region 30 as an alternative to translucent sheet 32 of FIG. 5. This embodiment is applicable to embodiments 2 and 3 set forth above.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the Claims appended herewith.

The invention claimed is:

1. An integrated mirror and graphics display system, comprising:

(a) a sheet of substantially transparent material, said sheet having a front and a back, said back having a silvered region and at least one primary non-silvered region;

(b) a translucent material comprising printing thereon including a graphic of interest to a system user, said translucent material disposed against the back of said transparent sheet against said non-silvered region; and (c) a substantially planar illumination element secured to said translucent material and also in optical communication with said transparent and translucent materials, said planar element sufficient in area to provide optical communication with an entirety of said at least one primary non-silvered region.

2. The system as recited in claim 1, said system including a plurality of non-silvered regions upon the back of said sheet of transparent material.

3. The system as recited in claim 1, in which said illumination element comprises a planar light fixture.

4. The system as recited in claim 3, in which said light fixture includes a plurality of light-emitting diodes.

5. The system as recited in claim 4, in which said light-emitting diodes emit light of any color.

6. The system as recited in claim 5, in which said illumination element defines an area sufficient to provide optical communication with at least one non-silvered regions.

7. The system as recited in claim 1, in which said sheet of translucent material comprises a polymeric material.

8. The system as recited in claim 1, further comprising:

a graphic of customer-specific information deposed within at least one non-silvered region beneath said primary non-silvered region of the system.

9. The system as recited in claim 8, in which said customer-specific information is applied to the front of a sheet of translucent material.

10. The system as recited in claim 8, in which said customer-specific information is applied to the front of the second non-silvered region by the use of a decal.

11. The system as recited in claim 8, in which said second non-silvered region is formed by masking or back-etching to define customer-specific information within said region.

12. The system as recited in claim 8, in which said second non-silvered region includes a translucent paint deposed upon the back of said transparent material.

13. The system as recited in claim 1, in which said silvered region comprises a region having an optically reflective agent deposed thereupon.

14. The system as recited in claim 1, further comprising:

a graphic or customer-specific information deposed upon the front of said sheet of transparent material and beneath said non-silvered area thereof.

15. The system as recited in claim 1, in which said translucent material defines a sheet of material at least equal in area to an area of said non-silvered region.

16. The system as recited in claim 1, in which said translucent material comprises a sheet having an area smaller than that of said non-silvered region.

17. The system as recited in claim 1, in which said translucent material comprises translucent paint.

* * * * *